US011918115B2

(12) United States Patent
Rosenberg

(10) Patent No.: US 11,918,115 B2
(45) Date of Patent: Mar. 5, 2024

(54) MOVABLE DIVIDER ASSEMBLY

(71) Applicant: Shmuel Yosef Rosenberg, Beit Shemesh (IL)

(72) Inventor: Shmuel Yosef Rosenberg, Beit Shemesh (IL)

( * ) Notice: Subject to any disclaimer, the term of this patent is extended or adjusted under 35 U.S.C. 154(b) by 0 days.

(21) Appl. No.: 17/838,221

(22) Filed: Jun. 12, 2022

(65) Prior Publication Data

US 2023/0397724 A1 Dec. 14, 2023

(51) Int. Cl.
*A47B 88/975* (2017.01)

(52) U.S. Cl.
CPC ..... *A47B 88/975* (2017.01)

(58) Field of Classification Search
CPC ... A47B 88/925; A47B 88/969; A47B 88/975; A47B 88/994; A47B 2088/0007; A47B 2088/202; A47B 2088/205; A47B 2088/976; A47B 57/58; A47B 57/583; A47B 96/04
See application file for complete search history.

(56) References Cited

U.S. PATENT DOCUMENTS 417,640 A * 12/1889 Hirsch ..... B65D 25/04 217/7
943,719 A * 12/1909 Vick ..... B65D 9/34 217/18
2,101,378 A * 12/1937 Wiskoff ..... A47B 88/975 217/70
2,127,827 A * 8/1938 Meyer ..... A47B 57/58 312/140
2,144,804 A * 1/1939 Irwin ..... A47B 88/975 211/184
2,214,042 A * 9/1940 Burdick ..... A47B 88/90 220/543
3,140,791 A * 7/1964 Hahn ..... A47B 88/994 24/350
4,705,168 A * 11/1987 Ward ..... A47B 88/988 206/376
4,899,928 A * 2/1990 Korff ..... A47B 88/994 220/532
5,884,782 A * 3/1999 Dembicks ..... A47B 88/90 211/175
2020/0317403 A1* 10/2020 Nilsson ..... B65D 7/20
2022/0088765 A1* 3/2022 Sand ..... A47B 88/975

FOREIGN PATENT DOCUMENTS

DE 1940731 A1 * 2/1971 ..... A47B 88/978
DE 9419588 U1 * 2/1995 ..... A47B 88/978
DE 29620396 U1 * 1/1997 ..... A47B 88/20
DE 202006005686 U1 * 7/2006 ..... A47B 88/20
DE 102010060534 A1 * 5/2012 ..... A47B 88/90
DE 202013102174 U1 * 8/2013 ..... A47B 88/20
DE 202020102073 U1 * 7/2020 ..... A47B 13/003
GB 2265308 A * 9/1993 ..... A47B 96/04

* cited by examiner

*Primary Examiner* — Andrew M Roersma
(74) *Attorney, Agent, or Firm* — Dekel Patent Ltd.; David Klein

(57) ABSTRACT

A divider assembly includes a divider guide element including a base member and at least one pivotable flap pivotally attached to the base member at a pivot. The pivotable flap may include an adhesive surface. A divider member is coupled to the divider guide element.

14 Claims, 5 Drawing Sheets

MOVABLE DIVIDER ASSEMBLY

FIELD OF THE INVENTION

The present invention relates generally to dividers or organizers and particularly to a divider which can easily be attached and re-attached at any desired place in a drawer, shelf and the like.

BACKGROUND OF THE INVENTION

Items in a drawer are often not kept in an orderly fashion. Dividers (also known as organizers, the terms being used interchangeably throughout) solve this problem by creating defined zones in which to place items, so that the items can be neatly sorted and stored in the drawer.

However, prior art dividers have some disadvantages. Installation of known dividers sometimes requires tools and may involve cutting and other permanent alteration of the divider, as well as nailing, gluing, clamping, and the like, to secure the divider within the drawer.

SUMMARY OF THE INVENTION

The present invention seeks to provide an improved a divider which can easily be attached and re-attached at any desired place in a drawer, shelf and the like, as is described more in detail hereinbelow.

There is provided in accordance with a non-limiting embodiment of the invention a divider assembly including divider guide elements, each of the divider guide elements including a base member, a guide member, and at least one pivotable flap pivotally attached to the base member at a pivot, and a divider member coupled to the divider guide element. The at least one pivotable flap may include an adhesive surface suitable for adhering to a surface of an object in which the divider member is placed.

In accordance with a non-limiting embodiment of the invention the adhesive surface includes nano-tape.

In accordance with a non-limiting embodiment of the invention the divider member is telescoping.

In accordance with a non-limiting embodiment of the invention the at least one pivotable flap includes a grasping member.

In accordance with a non-limiting embodiment of the invention the at least one pivotable flap includes a first flap member extending from a second flap member.

In accordance with a non-limiting embodiment of the invention the at least one pivotable flap includes a flexible tongue arranged to resiliently presses against an inner surface of the base member.

In accordance with a non-limiting embodiment of the invention the pivot includes a recess formed in the at least one pivotable flap and an edge included in the base member.

In accordance with a non-limiting embodiment of the invention, the at least one pivotable flap includes a pair of pivotable flaps, and when each of the pivotable flaps is pivoted away from the base member, gaps are exposed between first and second extension members formed on the base member.

In accordance with a non-limiting embodiment of the invention the divider member couples to the divider guide elements by a male-female connection. Alternatively, the divider member couples to the divider guide elements by an adhesive or magnetic connection.

BRIEF DESCRIPTION OF THE DRAWINGS

The present invention will be understood and appreciated more fully from the following detailed description, taken in conjunction with the drawings in which.

DETAILED DESCRIPTION

Figure 1:
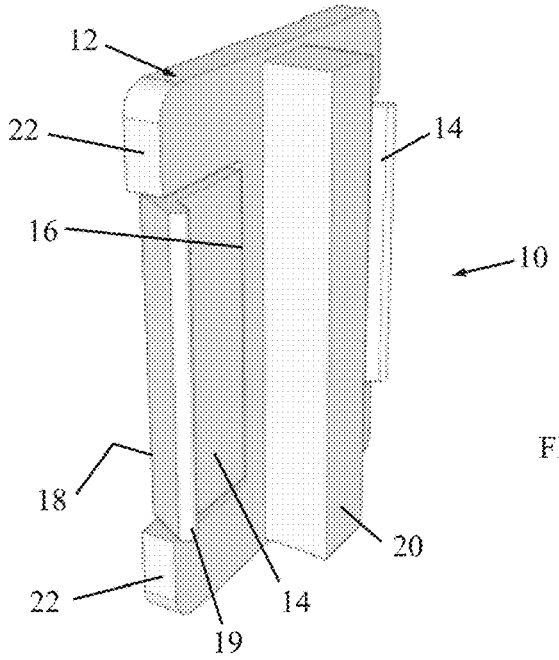
FIG. 1 is a simplified perspective illustration of a divider guide element, in accordance with a non-limiting embodiment of the invention.
Figure 2:
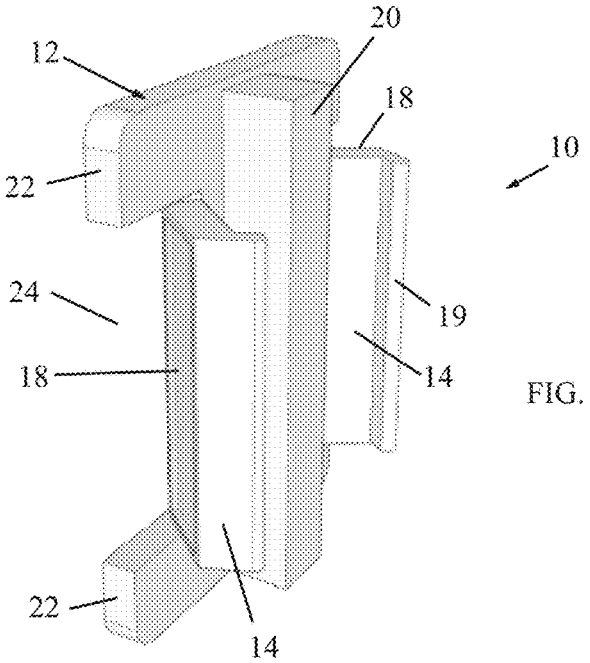
FIG. 2 is a simplified perspective illustration of the divider guide element, showing pivotable flaps with adhesive surfaces.

Reference is now made to FIGS. 1 and 2, which illustrate a divider guide element 10, in accordance with a non-limiting embodiment of the invention.

The divider guide element 10 may include a base member 12 and pivotable flaps 14 which are pivotally attached to base member 12 at pivots or hinges 16. The pivot or hinge 16 may be, without limitation, made of a pin, lugs and the like, or may be a living hinge. Each pivotable flap 14 may include an adhesive surface 18. In a preferred embodiment, the adhesive surface 18 is made of nano-tape, which is a synthetic double-sided or single-sided adhesive tape with arrays of carbon nanotubes on a backing material of flexible polymer tape. Nano-tape has excellent adhesion to inner walls of drawers or other dividers or other surfaces (made of metal, wood, plastic and other materials), and can be easily peeled off and moved to another place and then once again bonded to the new place in the drawer. The pivoting capability of pivotable flaps 14 make peeling the adhesive surface 18 away from its present mounting surface for re-attachment at another bonding site extremely straightforward and easy.

Each pivotable flap 14 may include a grasping member 19, such as but not limited to, a rim extension that extends from the flap.

The divider guide element 10 may include a guide member 20, such as a spine that protrudes from base member 12. In the illustrated embodiment, guide member 20 is rectangular, but can alternatively by other shapes and may have chamfered edges. The guide member 20 may have the same length as base member 12 or may be shorter or longer than base member 12.

Base member 12 may optionally have first and second (upper horizontal and lower horizontal, in the sense of the drawings) extension members 22. As seen in FIG. 2, when pivotable flaps 14 are pivoted from the attachment configuration (FIG. 1), gaps 24 are exposed between the first and second extension members 22.

Figure 3:
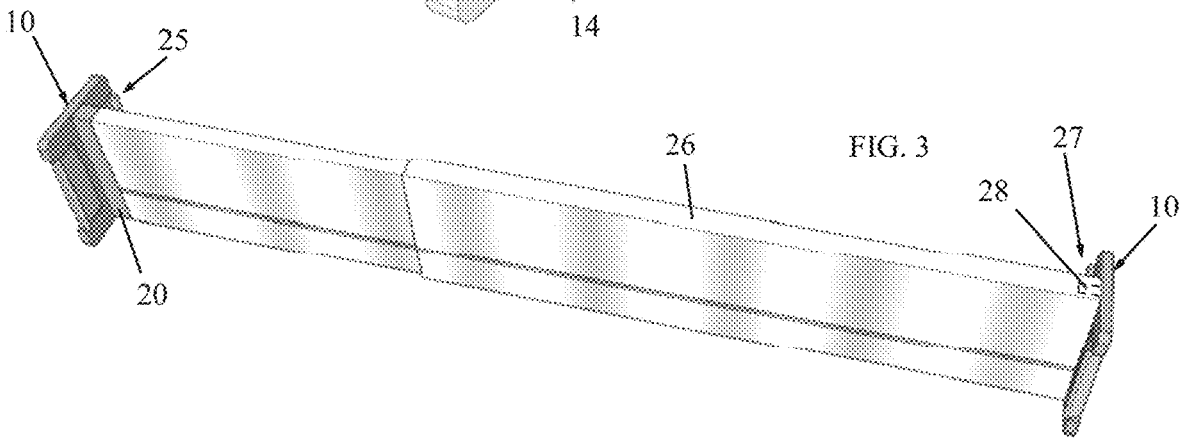
FIG. 3 is a simplified perspective illustration of a (e.g., telescoping) divider member coupled to a pair of divider guide elements at each end of the divider member, in accordance with a non-limiting embodiment of the invention.

Reference is now made to FIG. 3, which illustrates a divider member 26 coupled to a pair of divider guide elements 10 at each end of the divider member 26. The divider member 26 may be telescoping, so that its length can be easily adjusted.

The divider member 26 may be coupled to divider guide element 10 in a variety of manners. For example, as shown at reference numeral 25, divider member 26 may be coupled to guide member 20 of divider guide element 10 by magnetic means or by adhesive. As another example, shown at reference numeral 27, divider member 26 may be coupled to guide member 20 of divider guide element 10 by a male-female connection 28, such as but not limited to, a groove formed in the end of divider member 26 into which guide member 20 is received, or mortise-tenon connection or dowel-hole connection and the like.

Figure 4:
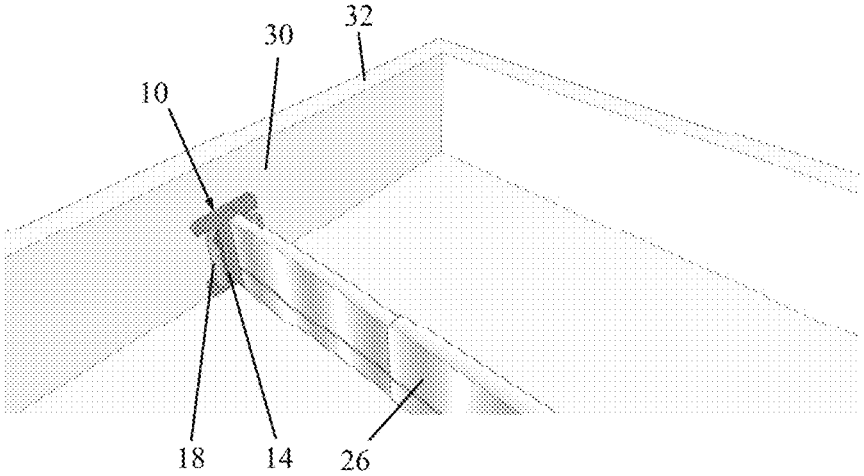
FIG. 4 is a simplified perspective illustration of the divider guide element about to be attached to an inner wall of a drawer.

Reference is now made to FIG. 4, which illustrates the divider guide element 10 about to be attached to an inner wall 30 of a drawer 32. The divider member 26, while it is coupled to the divider guide elements 10, is placed in the drawer 32 at the desired place. Each pivotable flap 14 is pivoted so that the adhesive surface 18 is not yet adhered to the inner wall 30.

Figure 5:
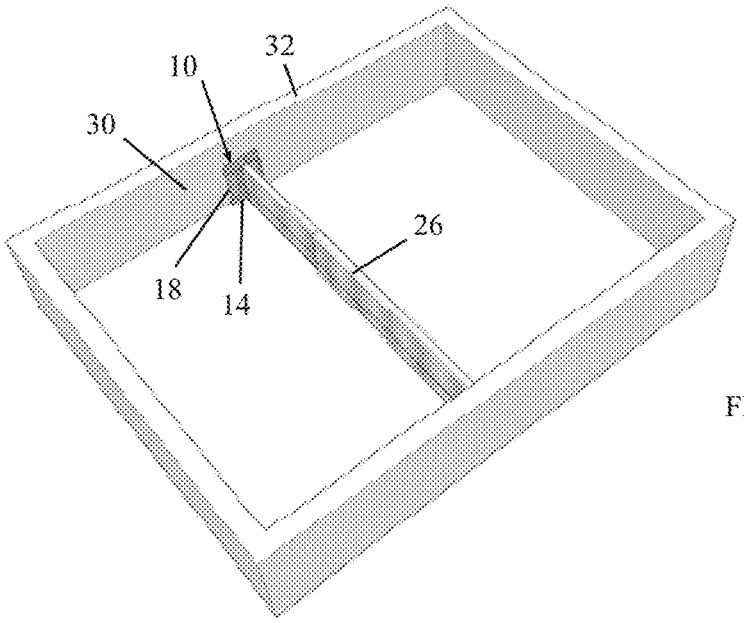
FIG. 5 is a simplified perspective illustration of the divider guide element and the divider member attached to the inner wall of the drawer.

Reference is now made to FIG. 5, which shows that pivotable flap 14 has been pivoted so that the adhesive surface 18 adheres to the inner wall 30. The divider guide elements 10 and the divider member 26 are now attached to the inner wall 30 of the drawer 32.

Figure 6:
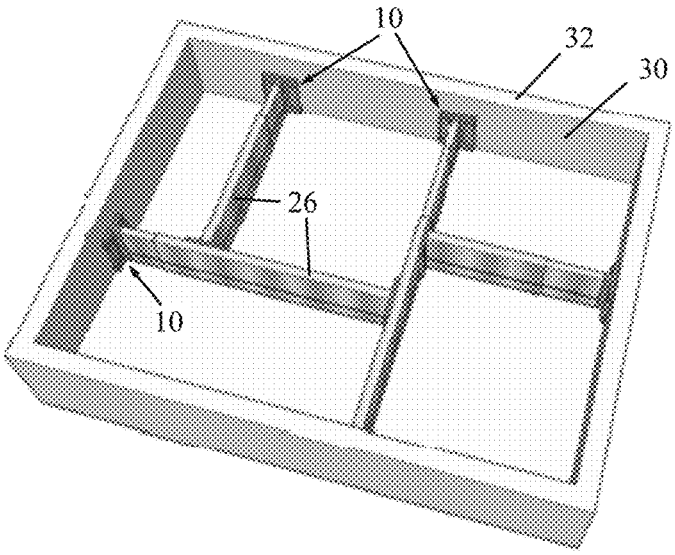
FIG. 6 is a simplified perspective illustration of divider guide elements and divider members attached to the drawer and to other divider members to define zones in which to place items in the drawer.

Reference is now made to FIG. 6. The user can make any arrangement of divider guide elements 10 and divider members 26 attached to the drawer 32 and/or to other divider members 26 to define zones in which to place items in the drawer 32.

Figure 7:
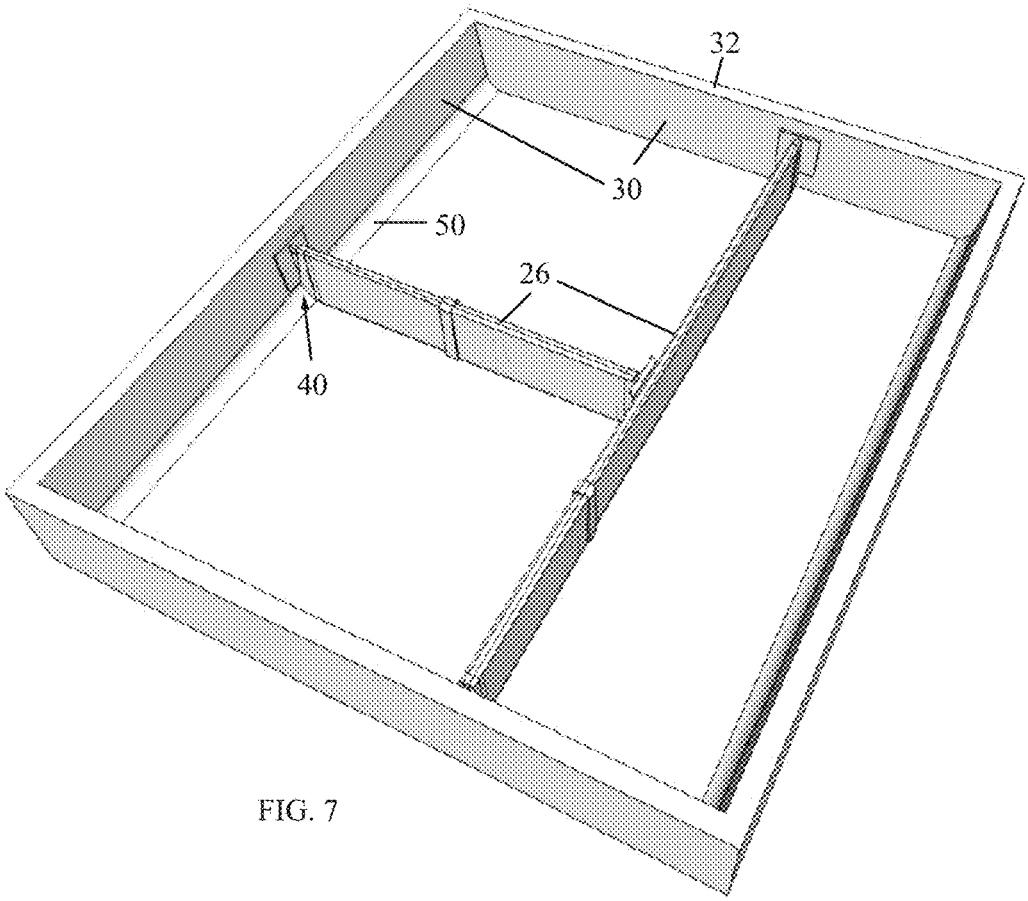
FIG. 7 is a simplified perspective illustration of divider guide elements and divider members attached to the drawer and to other divider members to define zones in which to place items in the drawer, in accordance with another non-limiting embodiment of the invention.
Figure 8A:
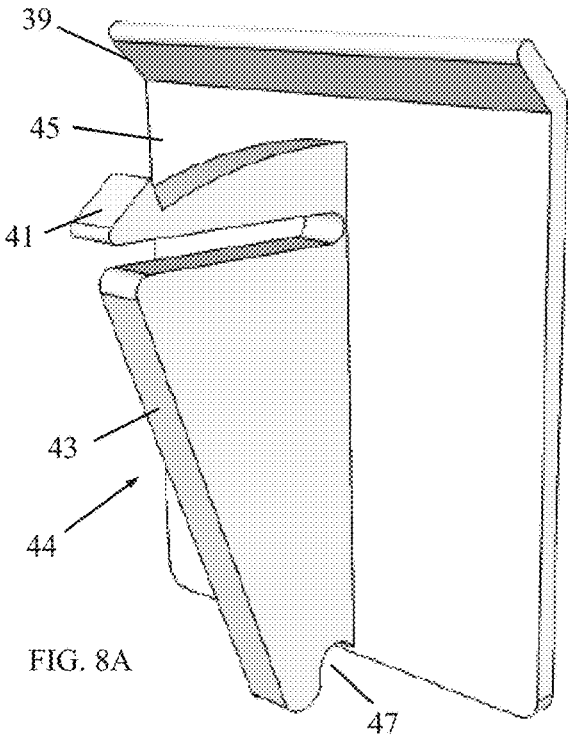
FIGS. 8A and 8B are simplified perspective illustrations of the divider guide element used in FIG. 7.

Reference is now made to FIG. 7, which illustrates divider guide elements 40 and divider members 26 attached to the drawer 32 and to other divider members 26, in accordance with another non-limiting embodiment of the invention. The divider guide element 40 is described with reference to FIGS. 8A and 8B, and its base member is described with further reference to FIG. 9.

The divider guide element 40 may include a base member 42 (seen in FIG. 9) and a pivotable flap 44 which is pivotally attached to base member 42 at a pivot or hinge 46. Pivotable flap 44 may include a first flap member 43 extending from a second flap member 45; first flap member 43 may be perpendicular to second flap member 45.

Pivotable flap 44 may include a flexible tongue 41, which may be part of first flap member 43.

Figure 9:
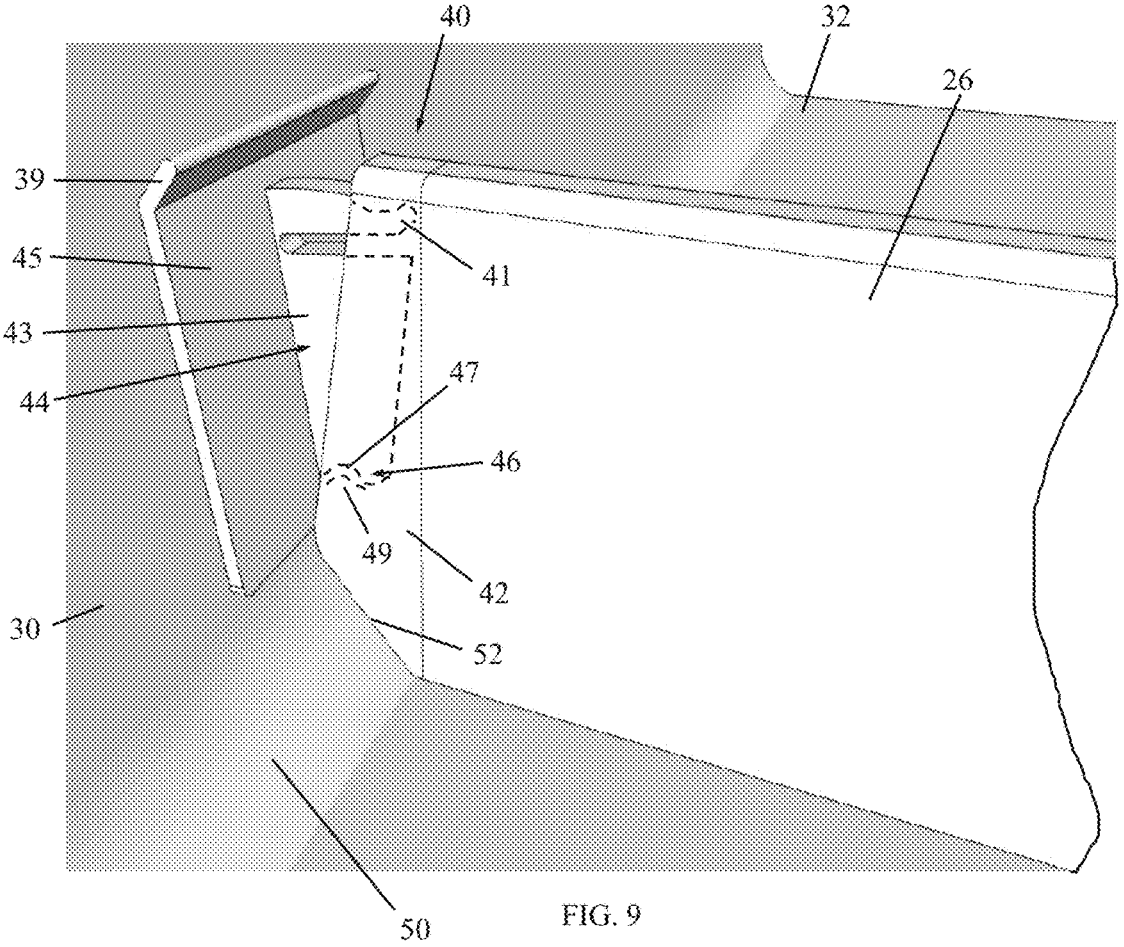
FIG. 9 is a simplified perspective illustration of the divider guide element of FIGS. 8A-8B and the divider member attached to the inner wall of the drawer, showing how the divider guide element is applicable for even curved interfaces.
Figure 11:
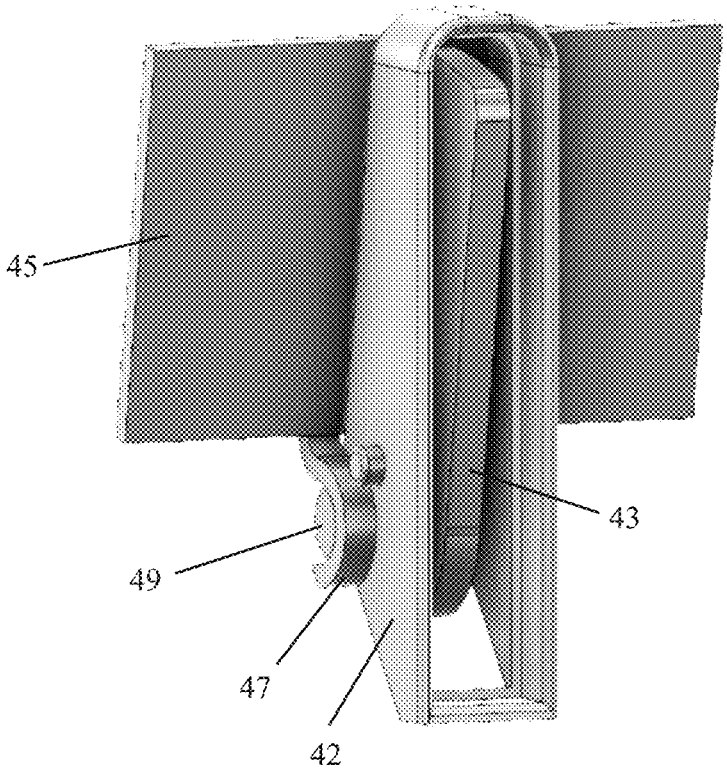
FIG. 11 is another simplified perspective illustration of the type of divider guide element of FIGS. 8A-8B.

As seen in FIG. 9, the pivot or hinge 46 may be, without limitation, made of a recess 47 formed in flap 44 (e.g., first flap member 43 of flap 44) and an edge 49 included in base member 42; the recess 47 pivots over edge 49 (FIG. 11 shows a slightly different version of FIG. 9). The pivotable flap 44 fits into a recess of base member 42 and flexible tongue 41 resiliently presses against an inner surface of base member 42 so that the pivotable flap 44 remains pivotally attached to base member 42.

Figure 8B:
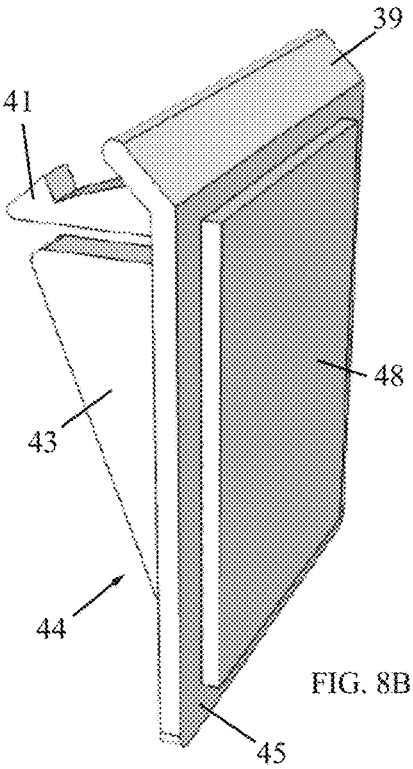

As seen in FIG. 8B, pivotable flap 44 may include an adhesive surface 48 (e.g., on a rear face of second flap member 45), which as described above, can be easily peeled off and moved to another place and then once again bonded to the new place in the drawer. Pivotable flap 44 may include a grasping member 39, such as but not limited to, a rim extension that extends from the flap (e.g., from second flap member 45).

As seen in FIGS. 7 and 9, the divider guide element is applicable for even curved interfaces. For example, the interface between the floor of the drawer 32 and the wall 30 is a curved interface 50. The base element 42 may have a non-perpendicular corner 52 (FIG. 9), such as but not limited to, a truncated corner or a curved corner, so that base member 42 does not interfere with the curved interface 50. Since the pivotable flap 44 pivots with respect to base member 42, the pivotable flap 44 can be adhered to the wall 30 at any angle, thereby compensating for any discrepancies due to curved interface 50, tolerances or other reasons.

Figure 10:
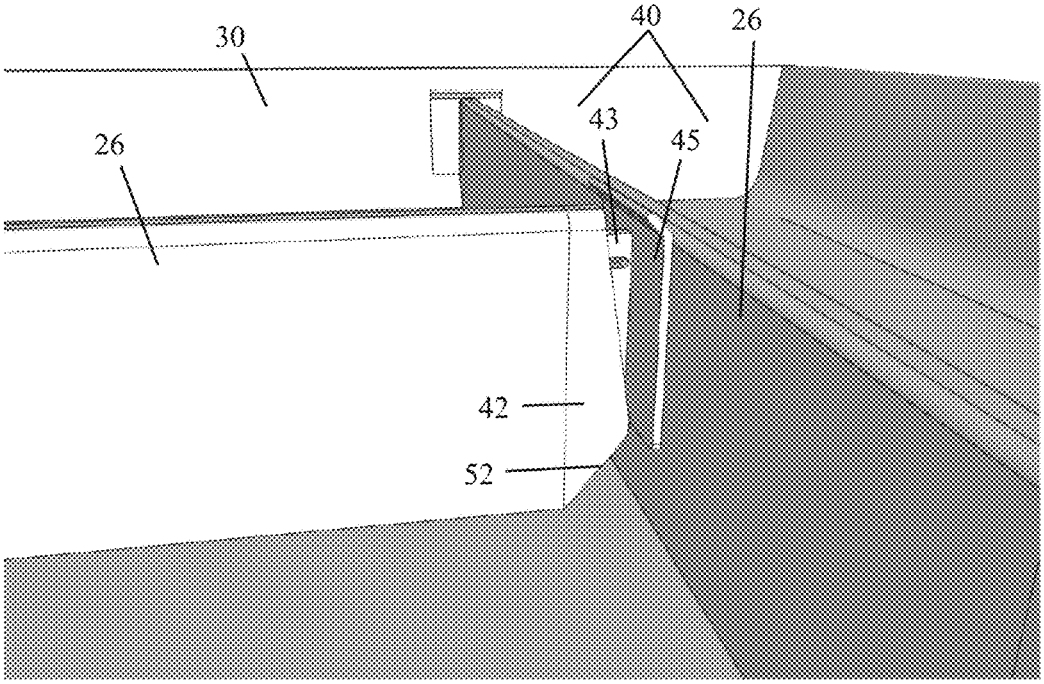
FIG. 10 is a simplified perspective illustration of the divider guide element and the divider member attached to another divider member.

FIG. 10 is a simplified perspective illustration of the divider guide element 40 and the divider member 26 attached to another divider member 26.

What is claimed is:

1. A divider assembly comprising:

a divider guide element comprising a base member, and at least one pivotable flap pivotally attached to said base member at a pivot; and a divider member coupled to said divider guide element, wherein said divider member comprises a long edge, which extends between opposite ends of said divider member, and said at least one pivotable flap pivots with respect to one of the ends of said divider member and is tiltable past an upright, perpendicular position so that said at least one pivotable flap tilts towards the other end of said divider member; and wherein said base member has a tilted end which extends from a starting point on said base member up to an upper surface of said base member, and said tilted end is tilted towards the other end of said divider member so that a total length of said divider member plus said base member is shorter at said upper surface than at said starting point.

2. The divider assembly according to claim 1, wherein said at least one pivotable flap comprising an adhesive surface suitable for adhering to a surface of an object in which said divider member is placed.

3. The divider assembly according to claim 2, wherein said adhesive surface comprises nano-tape.

4. The divider assembly according to claim 1, wherein one said divider guide element is coupled to one end of said divider member and another said divider guide element is coupled to an opposite end of said divider member.

5. The divider assembly according to claim 1, wherein said divider member is telescoping with respect to another divider member.

6. The divider assembly according to claim 1, wherein said at least one pivotable flap comprises a grasping member.

7. The divider assembly according to claim 1, wherein said at least one pivotable flap comprises a first flap member extending from a second flap member.

8. The divider assembly according to claim 1, wherein said at least one pivotable flap comprises a flexible tongue arranged to resiliently presses against an inner surface of said base member.

9. The divider assembly according to claim 1, wherein said pivot comprises a recess formed in said at least one pivotable flap and an edge included in said base member.

10. The divider assembly according to claim 1, wherein said divider assembly is mounted inside a drawer such that said starling point is abuttable against a wall of said drawer.

11. The divider assembly according to claim 1, wherein said divider member couples to said divider guide element by a male-female connection.

12. The divider assembly according to claim 1, wherein said divider member couples to said divider guide element by an adhesive or magnetic connection.

13. The divider assembly according to claim 1, wherein said tilted end does not extend to a bottom surface of said base member and instead extends to a non-perpendicular corner of said base member, said non-perpendicular corner extending from said bottom surface in a tilted manner so that a length of said divider member plus said base member is longer at an upper end of said non-perpendicular corner than at a lower end of said non-perpendicular corner.

14. The divider assembly according to claim 13, wherein said pivot is positioned above a junction of said tilted end and said base non-perpendicular corner.

* * * * *